United States Patent [19]

Reed

[11] 3,981,093

[45] Sept. 21, 1976

[54] GAS OPERATED LAUNCHER

[75] Inventor: Frederick P. Reed, Davenport, Iowa

[73] Assignee: The United States of America, Washington, D.C.

[22] Filed: Apr. 7, 1975

[21] Appl. No.: 556,366

[52] U.S. Cl. ..... 42/1 F
[51] Int. Cl.[2] ..... F41C 27/06
[58] Field of Search ..... 42/1 F; 102/65.2

[56] References Cited

UNITED STATES PATENTS

| | | | |
|---|---|---|---|
| 932,214 | 8/1909 | Wieser | 42/1 F |
| 1,003,079 | 9/1911 | Wieser | 42/1 F |
| 2,481,546 | 9/1949 | Walker | 42/1 F |
| 3,619,924 | 11/1971 | Paine | 42/1 F |

*Primary Examiner*—Charles T. Jordan
*Attorney, Agent, or Firm*—Nathan Edelberg; Robert P. Gibson; Harold H. Card, Jr.

[57] ABSTRACT

A launching device is adapted for removable attachment to the muzzle of a rifle barrel, and has a cup holding an explosive grenade or the like in launching attitude. Upon firing a blank cartridge in the rifle, discharge gases within the barrel activate the launcher, throwing the grenade through the air toward an enemy target.

4 Claims, 6 Drawing Figures

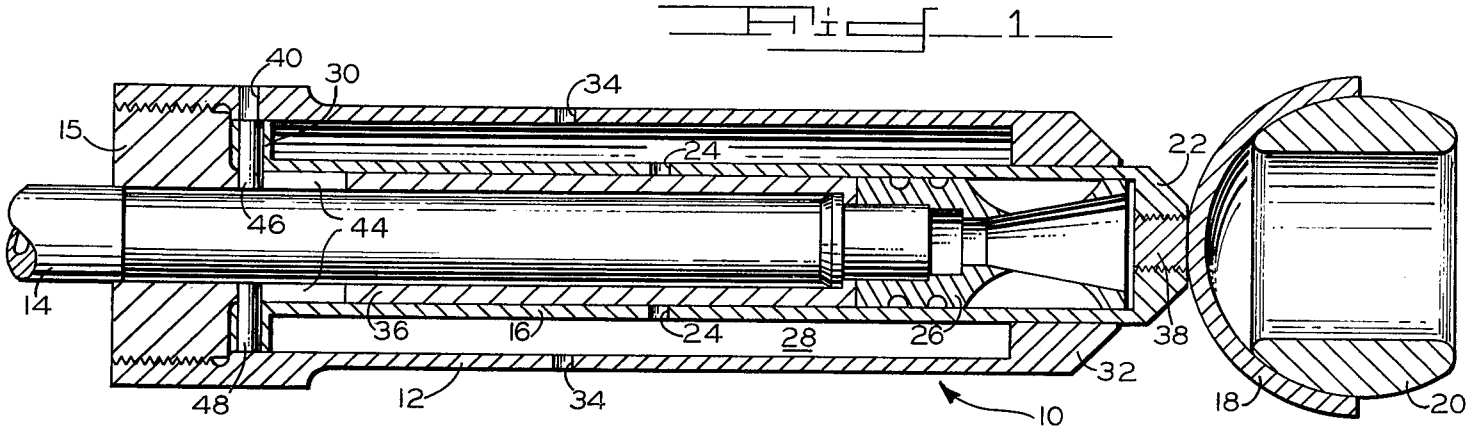
1
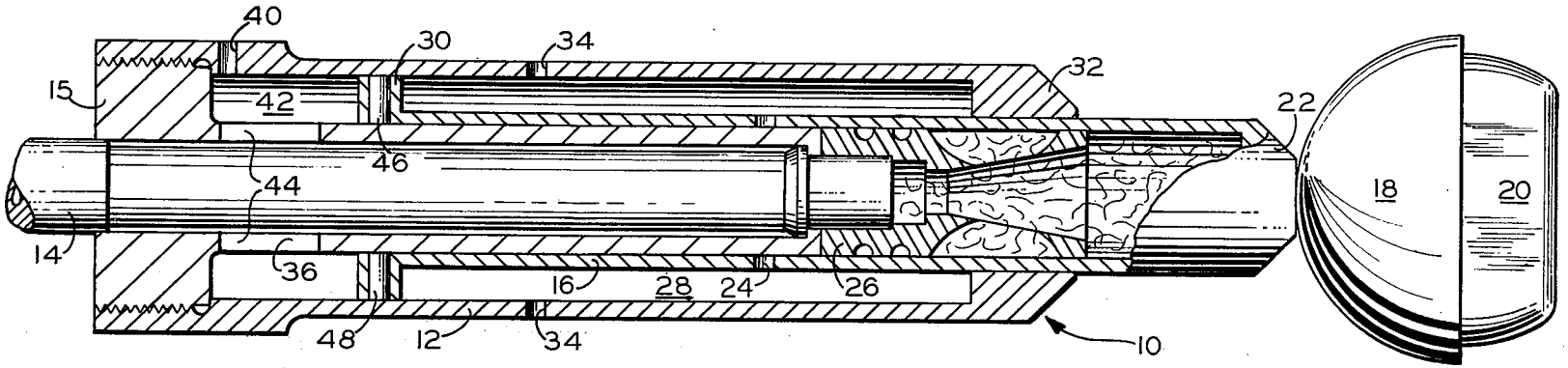
2

GAS OPERATED LAUNCHER

The invention described herein may be manufactured and/or used by or for the Government for governmental purposes without the payment of any royalty thereon.

BACKGROUND OF THE INVENTION

Grenade launchers attachable to rifle barrels known in the prior art usually involve spring mechanisms to counteract the launching force. Springs are poorly suited to this purpose where a maximum of acceleration is desired in the launching phase of operation, since compression of the spring may oppose such acceleration. Also, when two or more grenades are launched in rapid succession, it is desirable that the launcher return to the ready position rapidly after each shot, and with the least possible recoil force applied through the rifle stock. In addition, springs are well known to change their characteristics during prolonged use, especially where shock loads are involved, hence any system designed for a certain narrow range of spring forces will soon be operating outside the design condition because of the mentioned change in spring characteristics.

SUMMARY OF THE INVENTION

The invention comprises an assembly 10 essentially consisting of two concentric cylinders in telescoping relationship, the outer one 12 being secured on a rifle barrel 14 in stationary relationship therewith, and the inner one 16 having a cup 18 adapted to receive the mass 20 to be launched or hurled through the air toward a target.

Inner cylinder 16 is closed at the forward end 22 thereof where cup 18 is located. When a blank cartridge is fired in the rifle (not shown) the resulting gases in barrel 14 expand rapidly, applying force to end 22 of cylinder 16 and moving the entire cylinder forward as seen in FIG. 2. After a portion of the total forward movement of cylinder 16 occurs, a venting port 24 through the cylinder wall moves past a seal 26 near the muzzle end of barrel 14, permitting gas to pass into the annular space 28 between cylinders 12 and 16. Continued further movement of element 16 as seen in FIG. 4 results in closure of port 24 and compression of the entrapped gas in space 28 between annular piston 30 formed on cylinder 16 and annular seal 32 formed on cylinder 12. Compression of the stored gas causes an increased resistance to further forward movement of cylinder 16 whereby the cylinder is arrested and forcibly returned toward the static ready position for another launch to be made. During rearward movement of cylinder 16, a second venting port 34 in cylinder 12 is uncovered, allowing gas in space 28 to escape to the atmosphere. During the initial forward acceleration of cylinder 16, mass 20 is hurled into the air and leaves cup 18 when the cup begins its deceleration mode through compression of the mentioned gas in space 28.

BRIEF DESCRIPTION OF THE DRAWINGS

FIGS. 1 through 5 are side elevational crossectional views along a vertical plane through the inventive device showing different phases of operation, with portions of structure omitted.

FIG. 6 is an isolated perspective view of the structure in FIGS. 1 through 5, showing the structure omitted from FIGS. 1 through 5.

DESCRIPTION OF THE PREFERRED EMBODIMENT

Figure 1:
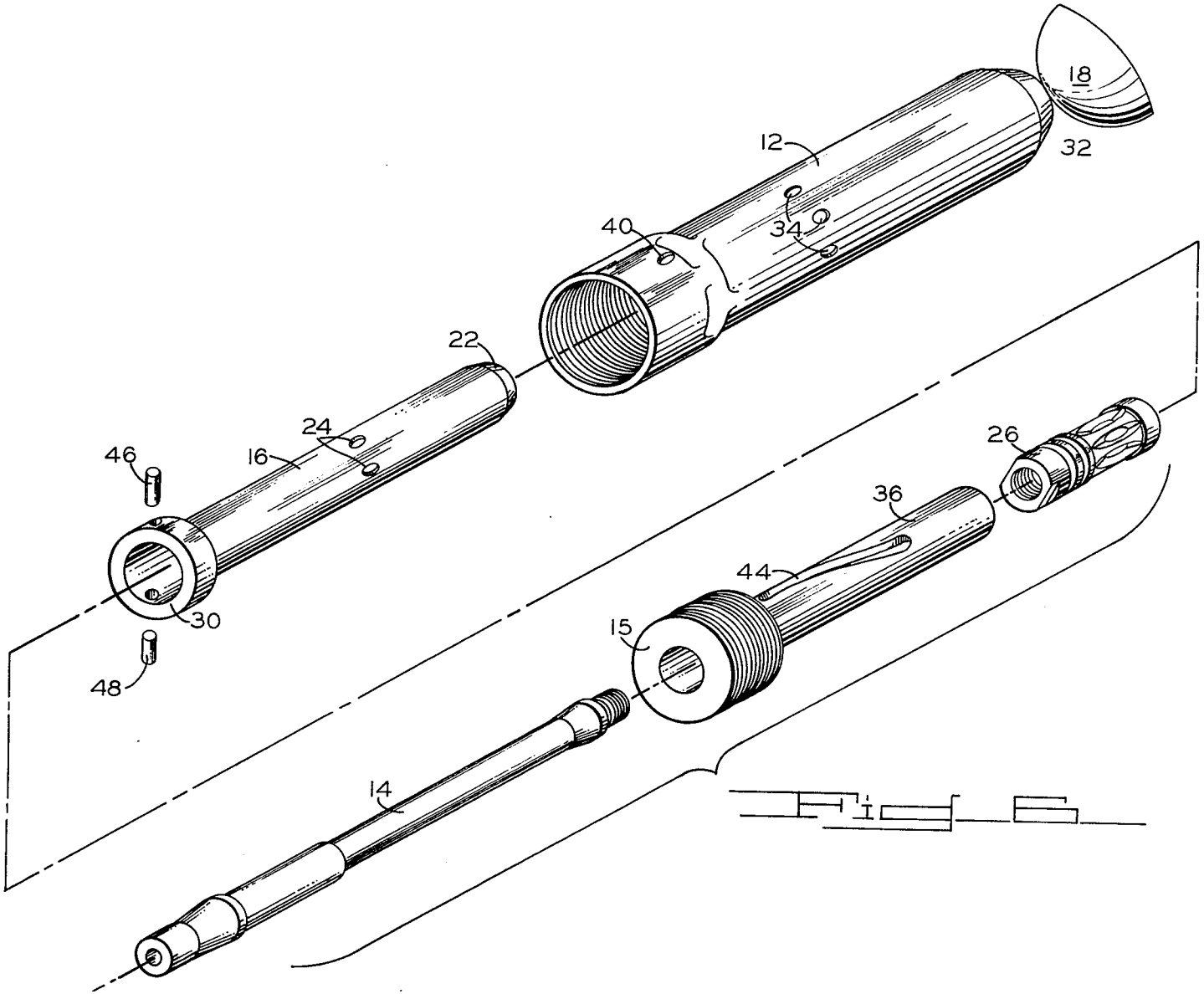

Referring to FIG. 1 the inventive structure is an assembly 10 adapted to be secured to the barrel 14 of a rifle (not shown) by suitable means such as engagement with a bayonet lug or the like. Assembly 10 includes outer cylinder 12 of elongate form closed at one end by any appropriate means such as base member 15 which is strongly affixed to the outer cylinder. The end of cylinder 12 opposite from base 15 is open but provided with sealing means in the form of seal 32 adapted to make sealing contact with the outer surface of inner cylinder 16 of assembly 10.

Base 15 is also integrally joined with or otherwise secured to an annular elongate guide element 36 which is in close sealing engagement with inner cylinder 16 and serves to control and guide the movement of the cylinder relative to the stationary element 36.

Cylinder 16 is closed at its forward end 22 and has container support means of any appropriate shape such as cup 18 secured to end 22 by any desired means such as threaded stub 38 at the base of the cup. The cup is adapted to receive and support a mass 20 to be launched by assembly 10 in a manner described below. Mass 20 may understandably be any of numerous sizes or shapes, and illustratively is shown in hollow annular form in FIG. 1. The end of cylinder 16 opposite from cup 18 is formed with an annular piston portion 30 comprising a radially projecting flange extending between elements 36 and 12. Venting ports 24 and 34 on cylinders 16 and 12, respectively, are provided for reasons discussed below. In addition, a venting port 40 is provided on cylinder 12 closely adjoining base 15 and covered by piston flange 30 when the launcher assembly is in a static state shown in FIG. 1 at the start of the launching sequence.

Figure 3:
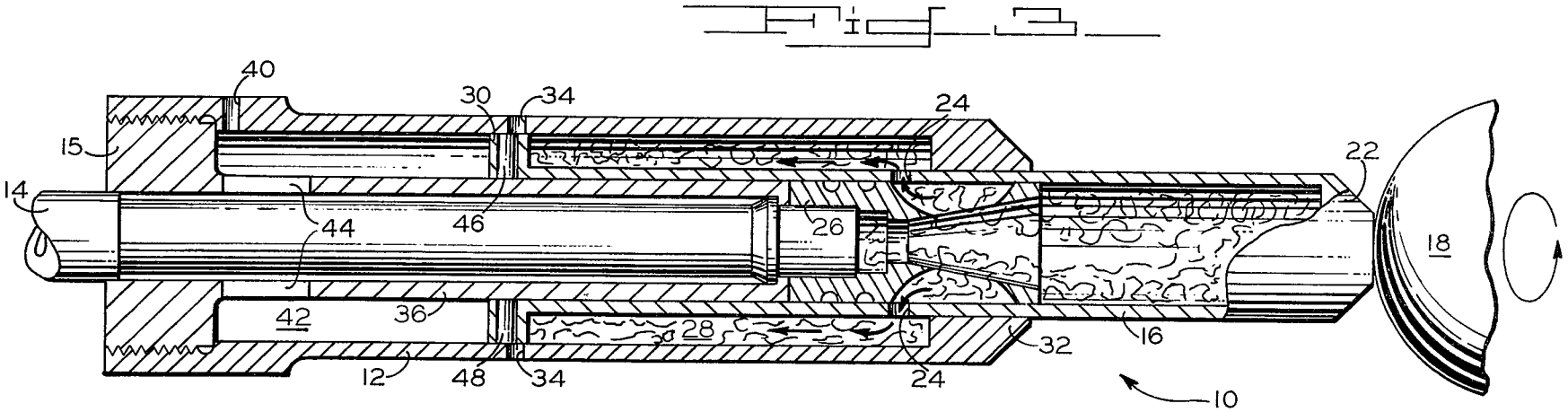

When it is desired to launch mass 20, a blank round in the breech (not shown) of barrel 14 is fired. Gases from the fired round then expand as much as possible, filling barrel 14 and exiting through the muzzle thereof as suggested in FIG. 1. Pressure is thus applied by the gases to the closed end 22 of cylinder 16, rapidly moving the cylinder and components affixed thereto forwardly with a fast rising acceleration. When sufficient forward movement of cylinder 16 has occurred for port 24 to move forwardly of seal 26, flange 30 will be at or beyond port 34 as seen in FIG. 3 where the flange is substantially aligned with the port, effectively blocking the same.

Figure 4:
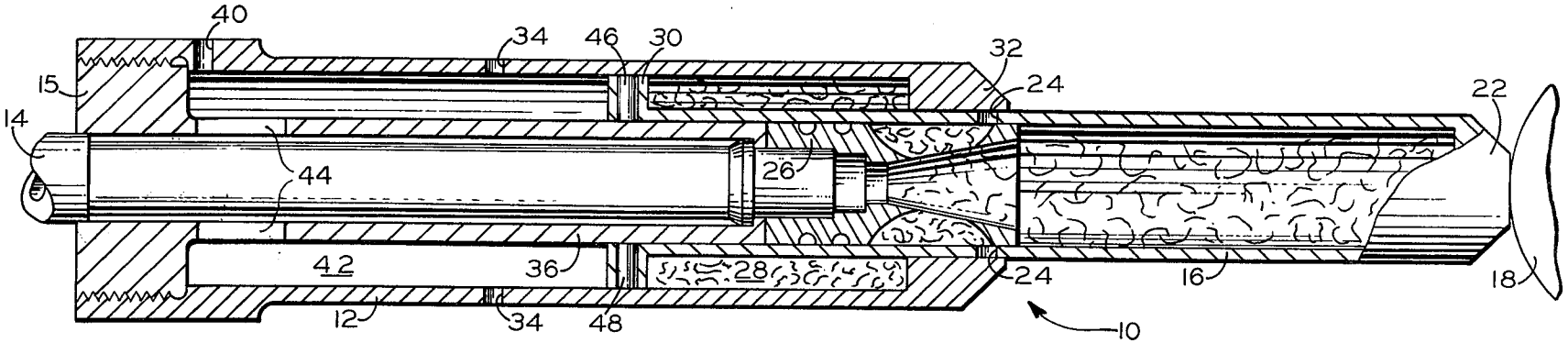
Figure 5:
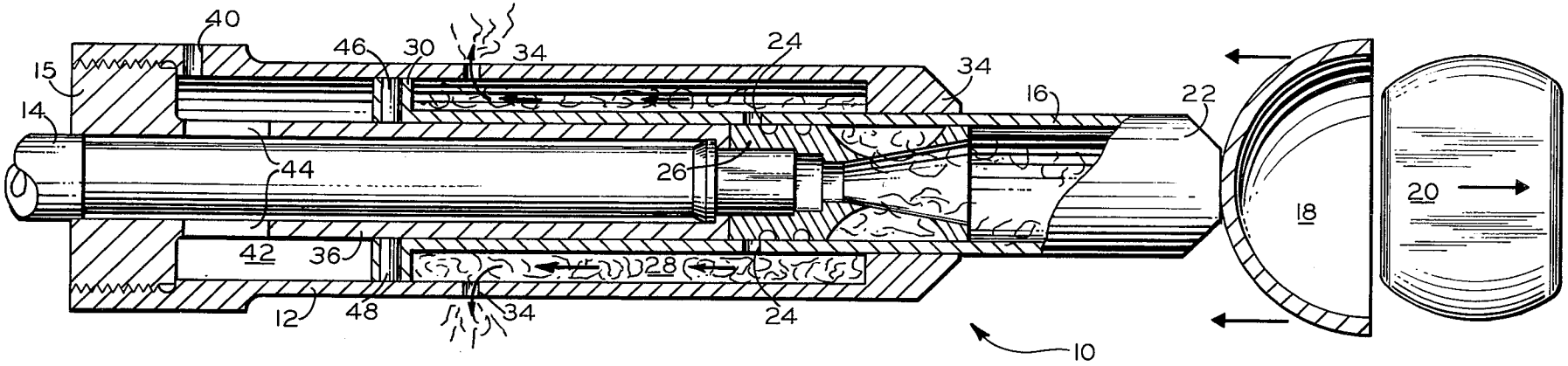

In this operative state gases from the muzzle of barrel 14 escape through port 24 into the annular chamber 28 defined by the space between cylinders 12 and 16 as limited by flange 30 at one end and seal 32 at the other end of space 28. Continued forward movement of cylinder 16, as shown in FIG. 4 for example, causes vent port 24 to move under seal 32, effectively isolating the entrapped gases in space 28 with no path of escape. The gases thus entrapped are under substantial pressure, and strongly resist any further forward movement of cylinder 16 after port 24 becomes blocked by seal 32. Reaction force from compression of gas within space 28 quickly decelerates and arrests forward movement of cylinder 16. The action is of course very rapid, so that peak acceleration forward by cup 18 is immediately followed by severe deceleration of the cup but not of mass 20 which leaves the cup under considerable momentum applied to the mass during the acceleration phase of cup travel.

After arresting forward movement of cylinder 16, the compressed gases in space 28 continue to apply force to flange 30, urging the flange and cylinder 16 to the rear. As flange 30 moves past port 34 during rearward travel, the port communicates space 28 to outer atmosphere and the entrapped gases escape. The moving parts continue toward the rear due to momentum, and air within space 42 which otherwise would be compressed by flange 30 escapes instead through vent port 40, thus accelerating return of the launching device components to ready launch position.

Referring to FIG. 6, means are also included to impart rotation to mass 20 during the short initial forward movement of cylinder 16 and cup 18 wherein peak acceleration is achieved. The stated rotating means, which have been omitted from FIG. 1 through 5 for the sake of clarity, include a short helical groove 44 which preferably is aligned 180° from a corresponding groove (not shown) on the opposite side of member 36. Both stated grooves are adapted to receive cam means in the form of projecting lugs 46 and 48 which are secured to flange 30 in cylinder 16 and extend radially inwardly into the mentioned helical grooves. When cylinder 16 is initially urged forward during launch operations, the grooves exert lateral force through camming action to lugs 46 and 48, imparting an incremental rotation to sleeve 16 and cup 18 mounted thereon. The rotation is sufficient to impart a rapid rotational force to mass 20 as it leaves cup 18 so that the mass continues spinning all the way to its point of impact, thus enhancing the flight stability and consequent aim prediction of the mass.

The structure disclosed herein has been found to achieve improved range capability and accuracy in adapting standard military rifles, such as issued to the infantry, for use in launching grenade or the like. Very high acceleration is achieved during as little as 2 inches of stroke in cylinder 16, followed by virtually no recoil in arresting the launching action and returning the launcher to ready position again. All of the forces produced in assembly 10 are applied or reacted entirely within the assembly itself, with little or no launching or recoil forces transmitted to the rifle on which the device is mounted. No resistance to launching movement is offered by any recoil or buffer mechanisms until peak acceleration is reached and gases become entrapped in chamber 28, after which deceleration of the mechanism is immediate but smooth, and the assembly returns to the ready condition with a minimum of delay. Also, it will be understood that the launching device described herein may be adapted to other and different devices than a gun. Thus, any gas-generating source wherein the gas is under sufficient pressure to actuate the launcher may be used, provided only that cylinder 12 is firmly held stationary together with the parts secured thereto and immovable with respect to the same.

I claim:

1. A launching device for hurling a mass toward a target comprising:

a first cylinder having an inner wall surface extending between and open and a closed end of said cylinder, a second cylinder concentric within said first cylinder and spaced apart therefrom to form an annular chamber between said first and second cylinders, said second cylinder having a closed end and an open end, said second cylinder being slidably movable in telescoping relationship between an extended and a retracted position relative to said first cylinder, first sealing means on said first cylinder extending between said first and second cylinders to seal one end of said chamber, gas generating means including an exit port within said second cylinder, second sealing means extending between said gas generating means and said second cylinder, an annular flange on said open end of said second cylinder, said flange having a periphery in continuous sealing contact with said inner wall of said first cylinder to seal the end of said annular chamber opposite from said one end of said chamber, first port means in said second cylinder for communicating said gas generating means with said annular chamber when said second cylinder is at a first position intermediate said extended and retracted positions, second port means on said first cylinder for communicating said chamber with outer atmosphere when said second cylinder is at a second position intermediate said extended and retracted positions, and support means connected to said closed end of said second cylinder for supporting said mass during operation of said launching device.

2. The device set forth in claim 1 above, wherein:

said gas generating means comprises a gun barrel adapted to fit inside said second cylinder.

3. In an adapter for a rifle to launch explosive materials:

first cylinder means for mounting on the muzzle end of a rifle barrel, second cylinder means telescopically movable within said first cylinder means, bearing support means between said first and second cylinder means for guiding said telescoping movement, guide cylinder means having helical grooves therein, said second cylinder means having projecting lugs therein engageable with said helical grooves to impart rotation to said second cylinder means during telescopic movement thereof, container means connected to said second cylinder means for containing a material to be launched, and, closure means on said second cylinder means for confining gas from said gun barrel whereby said gas moves said second cylinder means to cause said launch.

4. The structure described in claim 5 above, further including:

closed annular chamber means between said first and second cylinder means for compressing a portion of said gas during said movement of said second cylinder means to buffer said movement.

* * * * *